United States Patent [19]

Haines

[11] 4,207,706

[45] Jun. 17, 1980

[54] LATCH CONTROL FOR EXPLOSION RELIEF PANEL

[76] Inventor: Eugene F. Haines, 62 Asbury Ave., Ocean Grove, N.J. 07756

[21] Appl. No.: 966,613

[22] Filed: Dec. 5, 1978

[51] Int. Cl.[2] ..... E05C 15/02

[52] U.S. Cl. ..... 49/141; 49/394; 49/477; 220/314

[58] Field of Search.....49/141, 31, 394, 395, 49/477; 292/259, 201, 251.5; 16/147; 220/314

[56] References Cited

U.S. PATENT DOCUMENTS

| | | | |
|---|---|---|---|
| 1,645,171 | 10/1927 | Weiss | 220/314 |
| 2,514,927 | 7/1950 | Bernhard | 292/251.5 |
| 2,551,750 | 5/1951 | Liskey, Jr. | 49/477 X |
| 3,339,791 | 9/1967 | Frees | 220/314 |

*Primary Examiner*—Kenneth Downey

*Attorney, Agent, or Firm*—Zachary T. Wobensmith, 2nd; Zachary T. Wobensmith, III

[57] ABSTRACT

A latch control for an explosion relief panel is described in which the panel of relatively rigid construction, is normally retained in place by an arm pivotally mounted at one end, a pivotally mounted fork assembly at the other end of the arm which includes a magnetically responsive keeper which is loosely attached to the fork assembly, a magnet carried by the arm normally holding the keeper firmly to prevent rotation of the fork assembly about its pivotal axis. A plurality of springs exerting the desired force are interposed between the panel and the arm. The door carries a rigid post, adjustable in length, for movement with the panel against the force of the springs to apply a releasing force on the keeper to release the keeper and move the fork assembly to a release position so that the arm rotates and releases the panel. Seals for the panel are provided acting substantially in the plane of the panel to permit limited movement of the panel while retaining their sealing action and to avoid any loading by the seals on the panel in the direction of the pressure application on the panel.

12 Claims, 6 Drawing Figures

LATCH CONTROL FOR EXPLOSION RELIEF PANEL

BACKGROUND OF THE INVENTION

1. Field of the Invention

This invention relates to latch control for explosion relief panels and more particularly to a magnetically controlled latch.

2. Description of the Prior Art

It has heretofore been proposed to utilize closures or panels which are releasable by pressure applied thereon due to an explosion or which is in excess of a predetermined pressure level.

Schibli et al., in U.S. Pat. No. 3,861,080 show springs for retention of the closure while Hawes et al., in U.S. Pat. No. 3,332,175 show a vacuum chamber for panel retention.

Abeel, in U.S. Pat. No. 3,571,977 shows spring retained door latch mechanism released upon attainment of a predetermined internal pressure.

Bernhard, in U.S. Pat. No. 2,514,927, shows in FIGS. 1 to 4 a magnetic door holder in which the keeper 19 can be manually released from pole pieces 16 and 17 which are energized through pole plates 11 and 12 from a block 10 of magnetized material. The release is effected by handles 30, 31 on a pivotally mounted lever 20 on which the keeper 19 is carried so that less force is required than the holding force of the magnet. In FIGS. 5 and 6 a foot pedal 46 is provided for slidably separating the keeper plate 41 from the magnet 40. These structures with their manual or foot pedal release are wholly unsuited for the accurately controlled automatic pressure release of explosion doors or the like.

Reilly, in U.S. Pat. No. 3,453,777, shows a pressure venting panel assembly in which a pivotally mounted panel is secured by a magnetic latch. The magnet 76 is mounted to a bracket 72 on the window frame 12 for engagement either by a keeper 20, of magnetically attractive material such as iron, nickel or a magnetic alloy mounted on the casement 28, or by the casement 28 itself, if of magnetically attractive material. The magnetic latch and its mounting and with its use of a pivotally mounted panel and with no sealing of the panel have little in common with the invention hereinafter described with its linearly movable panel with spring loading and would not function in a comparable manner.

Sieverin, in U.S. Pat. No. 3,502,361 shows a magnetically biased tank vent. A flange 12 on a base 10 has an annular seat 14. A circular cover 16, hingedly mounted by hinge pin 18 to the base 10 with a diaphragm 20 engageable with the seat 14 for sealing. If the diaphragm 20 is to seal deflection of the diaphragm against a spring force must be available for that purpose. Exteriorly of the diaphragm 20 a plate 24 is provided on the cover 16 loosely carried on a bolt 26 for clearance adjustment and locked against rotation by a roll pin 32. The resilience of the diaphragm would be a force effective in opposition to the magnetic force. The Sieverin structure lacks a linearly movable panel, spring loading effective on the panel, seals which are effective normal to the forces moving the panel, and reliable and predictable release of the keeper from the magnet.

Elrod et al., in U.S. Pat. No. 3,844,597 shows a safety latch in which a permanent magnet is employed for maintaining the latch in engaging alignment.

None of the prior art devices show a rigid linearly movable light weight low inertia panel subject to pressure, held by an arm, with a pivotally mounted fork assembly having a keeper for engagement with a magnet carried by the arm, and with an adjustable length post carried by the panel for actuating the fork assembly for release and which is capable of repetitive action at relatively low pressure levels.

SUMMARY OF THE INVENTION

In accordance with the invention a latch control for an explosion relief panel is provided in which a linearly movable panel of relatively rigid construction is normally retained in place by a pivotally mounted arm with resilient members or springs interposed between the panel and the arm, the latching mechanism including a pivotally mounted fork assembly and which has a magnetically responsive keeper which is loosely attached to the fork assembly, a magnet carried by the arm engaged with the keeper to prevent rotation of the fork assembly about its pivotal axis, a rigid post on the panel and adjustable in length applying a releasing force on the fork assembly upon linear movement of the panel, seals being provided acting substantially in the plane of the panel and accordingly not affecting the pressure loading on the panel.

It is the principal object of the invention to provide an improved releasable magnetic type latch for pressurized panels.

It is a further object of the invention to provide an accurate pressure responsive release control for light weight panels.

It is a further object of the invention to provide an improved releasable magnetic type latch for pressurized panels in which spring loading is interposed between the panel and a retaining arm in accordance with the pressure load at which release of the panel is to be effected.

It is a further object of the invention to provide an improved releasable magnetic type latch for pressurized panels in which a retaining arm is employed, and in which a pivotally mounted fork is normally magnetically retained in locking position but which is released by linear movement of the panel by internal pressure applied thereon.

It is a further object of the invention to provide an improved releasable magnetic type latch in which a pivotally mounted fork is normally magnetically retained in locking position but is released by linear movement of the panel which actuates a post, preferably adjustable in length, which engages a fork to break the magnetic retention.

It is a further object of the invention to provide an improved releasable magnetic type latch for retaining linearly movable pressurized panels in place until an internal release pressure is attained and in which seals are employed which permit linear movement of the panels while retaining the seal and which do not affect the pressure loading.

It is a further object of the invention to provide a light weight yet rigid panel releasable upon application of a predetermined pressure thereon and in which seals are employed which are located outside the vessel.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
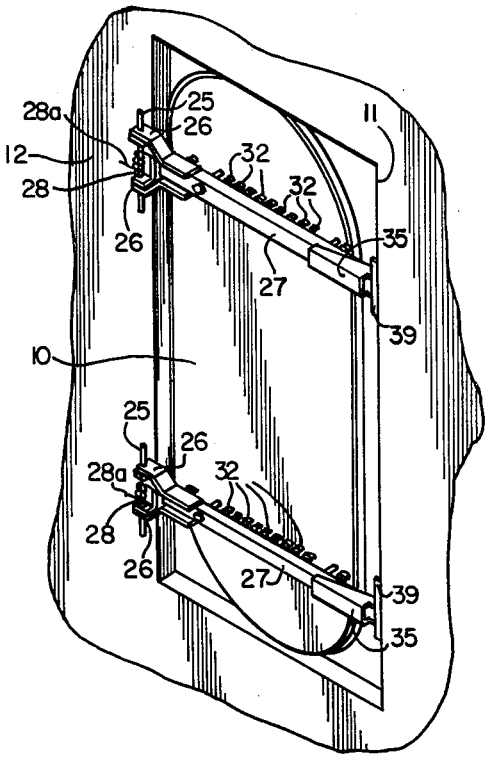
FIG. 1 is a view in perspective of a panel retained by structure in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings a door or panel 10 is shown, mounted in a frame assembly 11 on a retort, chamber, furnace, duct, air filter, blender, mixer, conveyor housing, processing tower, or the like hereinafter identified as an enclosure 12 for relief of explosion pressure or other excessive pressure within the enclosure 12.

The panel 10 can be made of any desired material which is adequately rigid and fluid tight and preferably light in weight. For this purpose the panel 10 can be made of aluminum honeycomb 14 between inner and outer face plates 15 and 16.

The frame assembly 11 preferably includes a rectangular channel frame 17 mounted on the enclosure 12 and supporting inner and outer frame plates 18 and 19 between which a frame rim 20 extends.

The frame rim 20 has a bracket 22 secured thereto for attachment by bolts 23 of an elongated bracket 24. A hinge pin 25 carried in the bracket 24 has end arms 26 of a box shaped arm 27 pivotally mounted thereon. A spring 28 carried on a sleeve 29 on the hinge pin 25 has one end **28*a* bearing on a plate 30 and the other end 28*b* engaged with the arm 27 for urging the arm 27 in the desired direction. A plurality of compression springs 32 are interposed between the arm 27 and a bearing plate 33 secured to the outer plate 16**.

The arm 27 has a channel shaped fork 35 pivotally connected thereto by a pivot pin 36. The fork 35 has spaced shoulders 38 for engagement with a bracket 39 secured to the frame rim 20.

The panel 10, spaced from the hinge pin 25 has a bolt 41 in threaded engagement in a post 42 to which a post cap 43 is held in assembled relation by a bolt 44. The post cap 43 has a head 45 to limit the relative movement in one direction of the arm 27 with respect to the panel 10 as urged by the springs 32.

The panel 10 inwardly of the fork 35 has a bolt 41 in threaded engagement in a post 42 to which a post cap 43 is held in assembled relation by a bolt 44. The post cap 43 has a head 45 to limit the relative movement in one direction of the arm 27 with respect to the panel 10 as urged by the springs 32. A set screw 46 is provided to permit of adjustment of the effective length of this post 42 and post cap 43 and thus a gap 47 can be made available.

It will be noted that relative linear movement of the posts 42 and their caps 43, and of the panel 10 with respect to the arm 27 under interior pressure is thus available.

The fork 35 has a keeper 50 loosely secured therein by a single rivet 51 and of a magnetic responsive material.

The arm 27 has secured therein a permanent magnet 52 for engagement by the keeper 50, the keeper 50 having a substantial overhang and being positioned for engagement by the set screw 46 upon predetermined outward movement of the panel 10.

Figure 2:
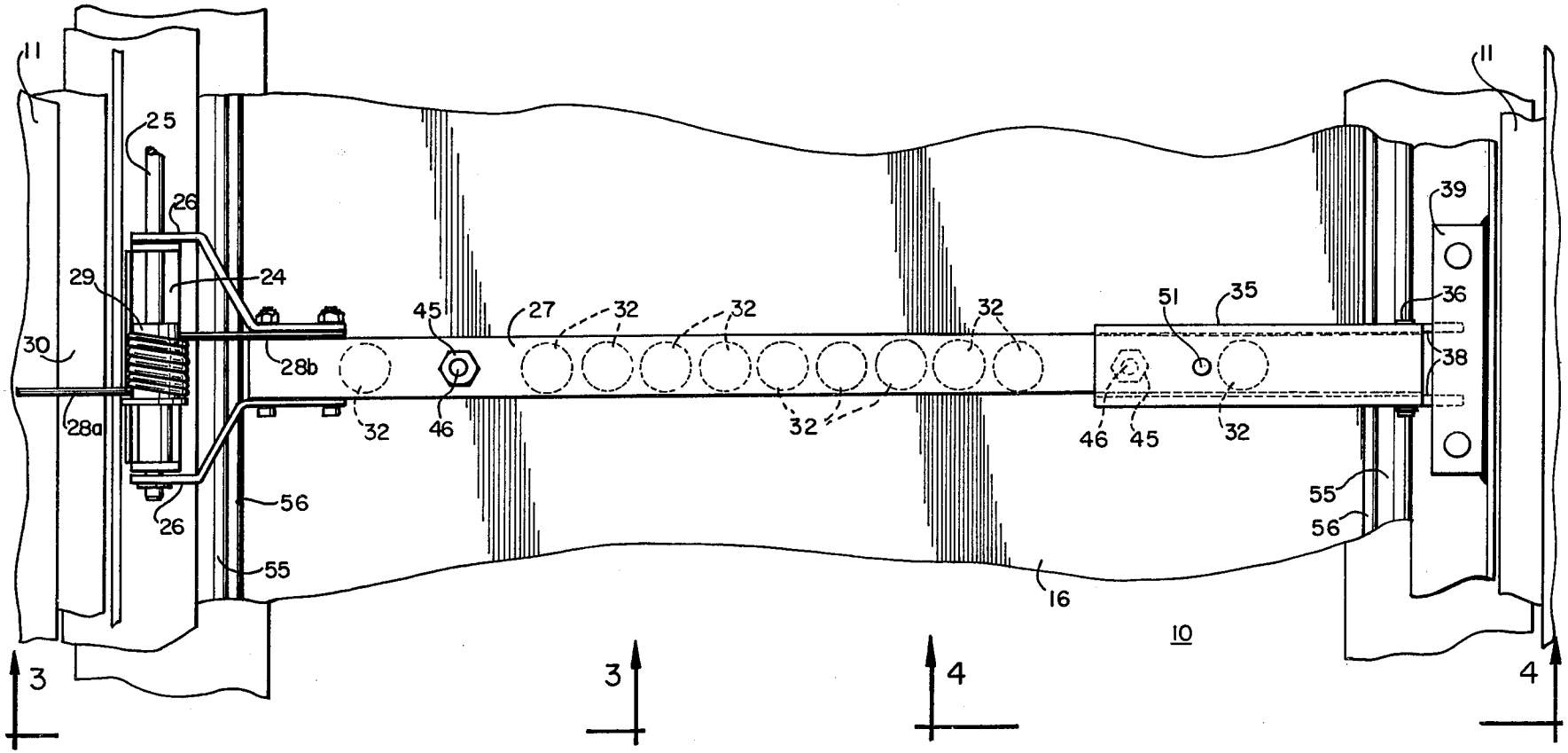
FIG. 2 is a front elevational view, enlarged, of a retaining arm with its end mounting and latch structure.
Figure 3:
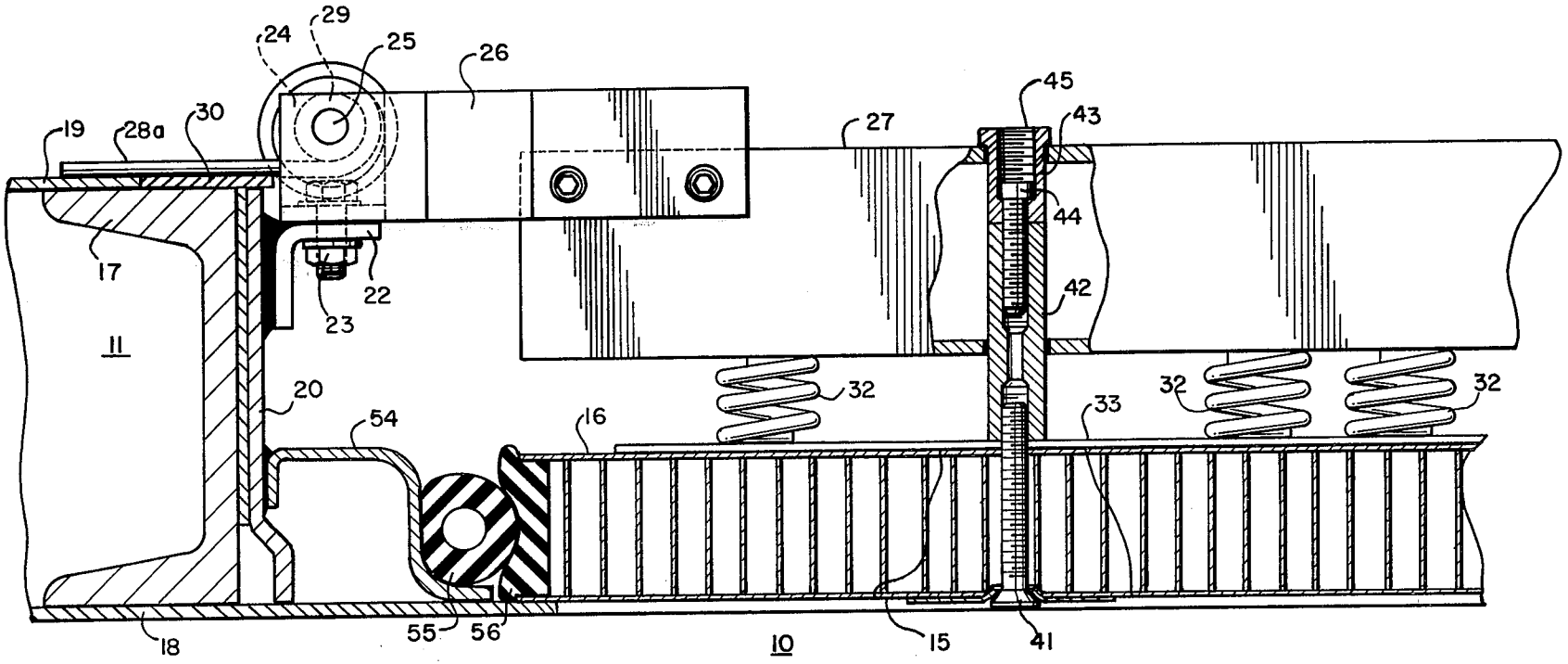
FIG. 3 is a fragmentary sectional view, enlarged, taken approximately on the line 3—3 of FIG. 2.
Figure 4:
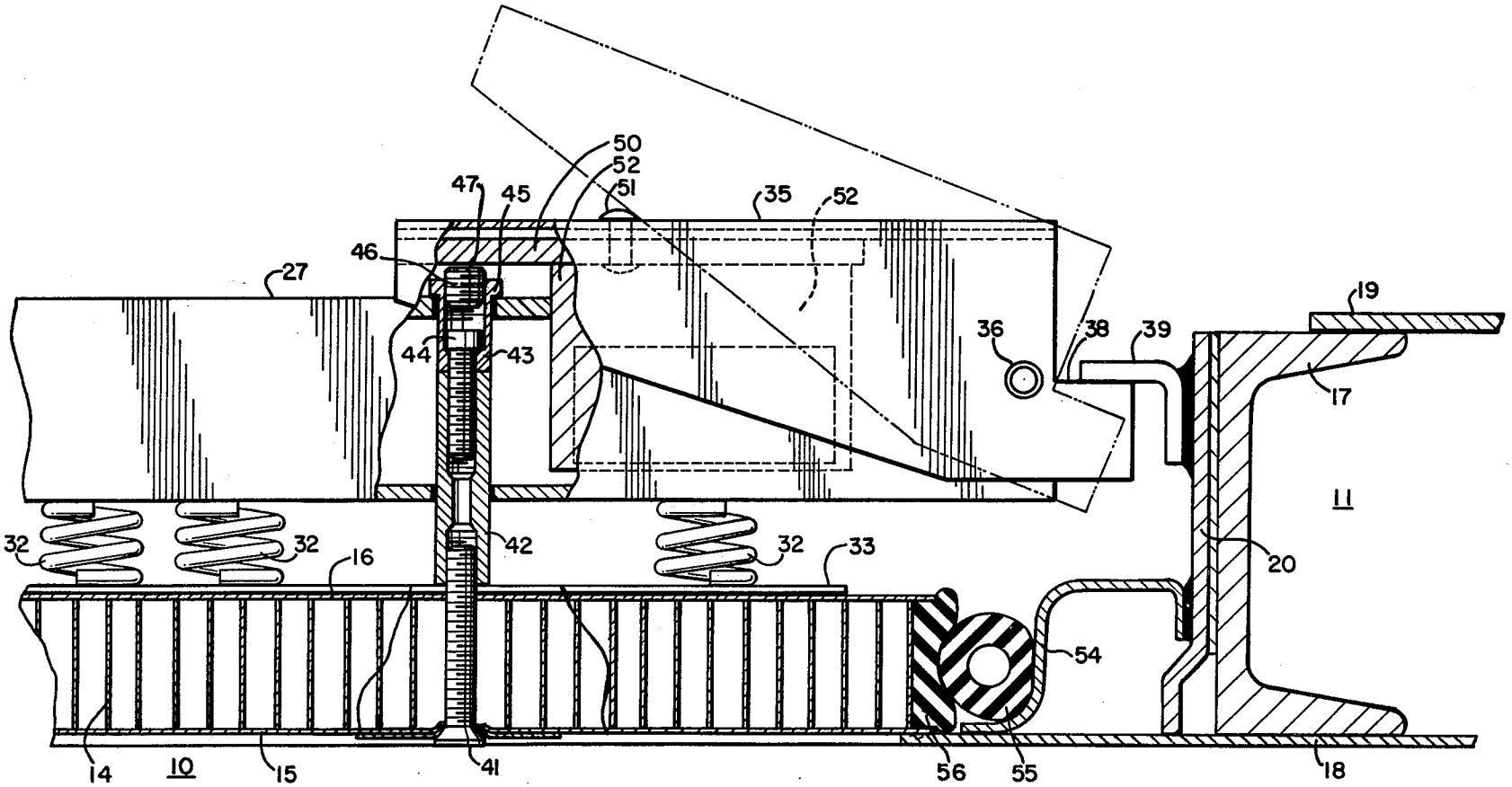
FIG. 4 is a fragmentary sectional view, enlarged, taken approximately on the line 4—4 of FIG. 2.

As illustrated in FIGS. 2, 3 and 4 the frame rim 20 has an inwardly extending gasket receiving rim 54 for engagement by a hollow flexible tubular seal gasket 55 which engages a flexible closure gasket 56 carried between the plates 15 and 16, the gaskets 55 and 56 extending around the periphery of the panel 10. These gaskets 55 and 56 act in the plane of the panel 10, i.e. perpendicular to the peripheral edge of the panel 10 and rim 54, and permit linear outward and inward movement of the panel 10 without separation of the seals at this location and without modifying the action of the pressure on the panel 10.

Figure 5:
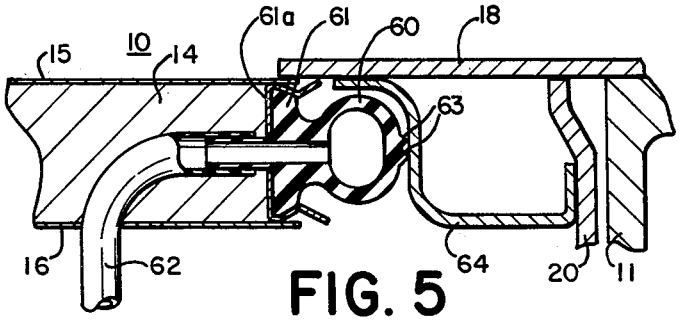
FIG. 5 is a transverse sectional view of a seal which can be employed at the periphery of the panel.

In FIG. 5 a different form of sealing gasket is illustrated which is suitable for internal pressures on the panel 10 above about twenty inches of water and which includes a hollow tubular section 60 secured to a mounting portion 61 carried in a resilient retainer **61*a* between the plates 15 and 16 and with a connection 62 to a source of constant fluid pressure. The tubular section 60 may have ribs 63 for engagement with a gasket receiving rim 64 carried on the frame rim 20**.

Figure 6:
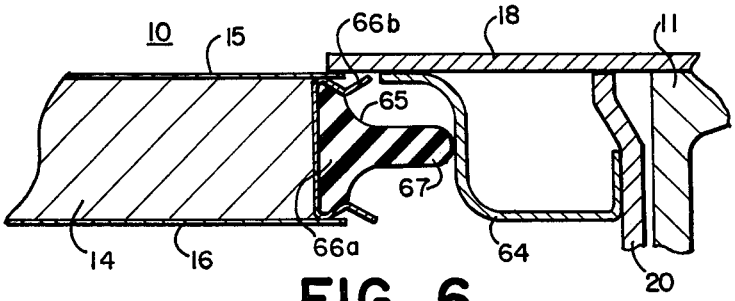
FIG. 6 is a transverse sectional view of another seal which can be employed at the periphery of the panel.

In FIG. 6 a different form of sealing gasket 65 is illustrated, substantially T-shaped in cross section with a mounting portion **66*a* in a resilient retainer 66*b* mounted between the plates 15 and 16 and with a stem 67 bearing on the gasket receiving rim 64 as before. This seal is suitable for internal pressures on the panel 10** below about twenty inches of water.

The gaskets 55, 56, 60 and 65 are made of any suitable elastomers.

The action of the sealing gaskets in FIGS. 5 and 6 is similar to that of the sealing gaskets previously described in permitting linear movement of the panel 10 without breaking the sealing action.

The mode of operation will now be pointed out.

The arm 22 is carried on the hinge pin 25 and normally urged, as desired, either outwardly or to a position parallel to the outer frame plate 19, by the spring 28.

The fork 35 has its shoulders 38 engaged with the inner face of the bracket 39.

The keeper 50 is in engagement with the magnet 52 and normally retains the fork 35 in its holding position, the fork 35 being incapable under this condition of rotating on its hinge pin 36 unless dislodged as hereinafter pointed out.

The panel 10 is positioned with respect to the arm 27 by the springs 32 and the posts 42 and post caps 43 limit the extension of the springs 32.

It will be noted that the posts 42 and post caps 43 are movable with respect to the arm 27 so that movement of the panel 10 will tend to compress the springs 32 and move the posts 42 and post caps 43 linearly outwardly. The spring force and number of springs 32 will determine the force required to be applied on the inner face 15 of the panel 10 for a predetermined movement.

Assuming that a pressure of sufficient magnitude for pressure relief is applied on the inner face 15 of the panel 10, the set screw 46 at the end of its post cap 43 will move into engagement with the keeper 51 and by further outward movement dislodge it from engagement with the magnet 52. The stored energy in the springs 32 will move the arm 27 to a position where the post caps 43 prevent further movement thereby rotating the fork 35 to an outer position, permitting rotation of the arm 27 about its pivot 25 for separation of the panel 10 from the frame rim 20. The dislodgment of the keeper 51 from the magnet 52 is not dependent on the quality of the contact of the keeper 51 with the magnet 52.

The action of the seals in FIGS. 2, 3 and 4 and of the seals in FIGS. 5 and 6 with force applied normal to the forces moving the panel 10 does not appreciably affect the operating conditions of the panel 10 since they do not act as release forces.

After pressure relief from the interior of the enclosure 12 has been effected, the arm 27 can be swung to closing position, the panel 10 moved inwardly with respect to the seals, and the fork 35 moved to bring the keeper 50 into engagement with the magnet 51 for normal retention and for release if pressure beyond a predetermined level is again effective on the inner face 15 of the panel 10.

I claim:

1. Apparatus for relief of excess pressure from an enclosure which comprises a closure panel having an inner face for application of pressure thereagainst, a frame on the enclosure for reception of the panel, at least one arm movably mounted at one end on the frame and extending across the panel and on which said panel is mounted in sealing relation to said frame, said panel being capable of limited linear movement with respect to the arm upon application of pressure to the inner face of the panel, resilient members interposed between said panel and said arm, releasable means at the other end of said arm for retaining said arm with said panel in said frame, said releasable means at the other end of said arm including a pivotally mounted fork for retaining said arm with said panel in sealing relation to said frame, magnetic means including a magnet and a keeper for retaining said fork in position, and a member carried by said panel for disengaging said magnetic means upon predetermined outward movement of said panel with respect to said arm.

2. The combination defined in claim 1 in which said fork is pivotally mounted on said arm, and said frame is provided with an abutment with which said fork is in engagement when said panel is in said frame.

3. The combination defined in claim 1 in which said last mentioned member is adjustable in length.

4. The combination defined in claim 1 in which said keeper is carried by said fork, and said magnet is mounted on said arm.

5. The combination defined in claim 1 in which said panel is of rigid construction.

6. The combination defined in claim 1 in which said panel is of light weight construction.

7. The combination defined in claim 1 in which sealing members are interposed between the periphery of said panel and said frame exteriorly of said enclosure and exerting sealing forces perpendicular to the edges of the panel, said sealing members permitting limited movement of said panel without loss of sealing and for release without substantially affecting the pressure loading on the panel.

8. The combination defined in claim 1 in which said sealing members includes a seal member of substantially circular cross section.

9. The combination defined in claim 1 in which said sealing members include an expansible pressure fluid containing seal member.

10. The combination defined in claim 1 in which said sealing members include a seal member having a stem portion parallel to the plane of the panel.

11. Apparatus for relief of excess pressure from an enclosure which comprises a closure panel having an inner face for application of pressure thereagainst, a frame on the enclosure for reception of the panel, an arm movably mounted at one end on the frame and extending across the panel and on which said panel is mounted for limited linear movement with respect to the arm upon application of pressure on the inner face of the panel, resilient members interposed between said panel and said arm, and releasable means at the other end of said arm for retaining said arm with said panel in said frame, said releasable means including a pivotally mounted fork, magnetic means including a magnet mounted on said arm and a keeper carried by said fork and having a portion extending beyond said magnet for retaining said fork in position, a member carried by said panel and engaging said keeper portion for disengaging said keeper from said magnet for release upon predetermined outward movement of said panel with respect to said arm.

12. The combination defined in claim 11 in which said magnet is more closely spaced with respect to the pivotal mounting of the fork than said extending portion.

* * * * *